US007742272B2

(12) United States Patent
Kubo et al.

(10) Patent No.: US 7,742,272 B2
(45) Date of Patent: Jun. 22, 2010

(54) HANDLING MACHINE USING LIFTING MAGNET

(75) Inventors: Takashi Kubo, Chiba (JP); Kiminori Sano, Chiba (JP); Hiroshi Ishiyama, Chiba (JP); Tadao Komoriya, Chiba (JP)

(73) Assignee: Sumitomo (SHI) Construction Machinery Manufacturing Co., Ltd., Chiba-shi, Chiba (JP)

( * ) Notice: Subject to any disclaimer, the term of this patent is extended or adjusted under 35 U.S.C. 154(b) by 392 days.

(21) Appl. No.: 11/883,290

(22) PCT Filed: Jul. 8, 2005

(86) PCT No.: PCT/JP2005/012646

§ 371 (c)(1),
(2), (4) Date: Sep. 10, 2007

(87) PCT Pub. No.: WO2006/080100

PCT Pub. Date: Aug. 3, 2006

(65) Prior Publication Data

US 2008/0068772 A1 Mar. 20, 2008

(30) Foreign Application Priority Data

Jan. 31, 2005 (JP) ..... 2005-023637

(51) Int. Cl.
*H01H 47/00* (2006.01)
*H01H 47/32* (2006.01)

(52) U.S. Cl. ..... 361/159; 361/143; 361/144

(58) Field of Classification Search ..... 361/159, 361/143, 144
See application file for complete search history.

(56) References Cited

U.S. PATENT DOCUMENTS 4,503,940 A 3/1985 Watanabe
5,333,452 A * 8/1994 Dameron ..... 60/484

(Continued)

FOREIGN PATENT DOCUMENTS

JP 4-256692 9/1992

(Continued)

*Primary Examiner*—Fritz M. Fleming
*Assistant Examiner*—Lucy Thomas
(74) *Attorney, Agent, or Firm*—Squire, Sanders & Dempsey L.L.P.

(57) ABSTRACT

It is realized to efficiently energize a lifting magnet device, and reduce the devices used in an energization system of the lifting magnet device in size, energy consumption, and noise as well. Other than a lifting magnet device 8, the handling machine includes an engine 1 and an electric generator 5, which form a power source; a storage battery 20 for storing electric energy from the power source; and a generator motor (or a drive source for a driven body) 18 for driving an upper rotary body in which regenerative electric energy can be produced. The power source and the storage battery 20 are connected to be capable of supplying electric energy to the lifting magnet device 8. The generator motor 18 for driving the upper rotary body is connected to be capable of supplying its own regenerative electric energy to the storage battery 20. The generator motor 18 is also connected to be capable of supplying regenerative electric energy directly to the lifting magnet device 8 without the intervention of the storage battery 20.

11 Claims, 5 Drawing Sheets

U.S. PATENT DOCUMENTS

| | | | | |
|---|---|---|---|---|
| 5,988,307 | A * | 11/1999 | Yamada et al. | 180/243 |
| 6,688,481 | B1 * | 2/2004 | Adner et al. | 212/195 |

FOREIGN PATENT DOCUMENTS

| | | |
|---|---|---|
| JP | 2000-201492 | 7/2000 |
| JP | 2000-295717 | 10/2000 |
| JP | 2001-261279 | 9/2001 |
| JP | 2002-242234 | 8/2002 |
| KR | 21885 | 7/1986 |
| KR | 400766 | 1/2005 |
| KR | 466766 | 1/2005 |
| SU | 1271814 | * 11/1986 |
| WO | 01/00934 | 1/2001 |

* cited by examiner

HANDLING MACHINE USING LIFTING MAGNET

TECHNICAL FIELD

The present invention relates to a handling machine using a lifting magnet, and in particular to a handling machine which can efficiently energize a lifting magnet device.

BACKGROUND ART

Conventionally, so-called handling machines using lifting magnets (e.g., materials handling apparatus) have been widely used. The handling machine uses a powerful electromagnet so as to retainably attract magnetic members such as ferrous materials and then release the retainably attracting force at a location to which the members are transferred. For example, a typical conventional handling machine using a lifting magnet is one shown in FIG. 4. With reference to FIG. 4, the handling machine (its main body is not shown in FIG. 4) includes an engine 1. The engine 1 is provided in common, on a drive shaft thereof, with a main pump (hydraulic pump) 2 for supplying a pressurized working fluid to required hydraulic actuators, including each cylinder and each hydraulic motor on the machine main body side, and with a generator hydraulic pump 3. The discharge outlet of the generator hydraulic pump 3 is in communication with the pressurized fluid inlet of a generator hydraulic motor 4, and an electric generator 5 is directly coupled to the generator hydraulic motor 4.

The output terminal of the electric generator 5 is connected with a converter 6 for converting AC output of the electric generator 5 into DC output. The converter 6 is connected with a DC-DC converter 7 in a stage downstream of the converter 6. The DC-DC converter 7 converts the DC output, which has been obtained through the conversion by the converter 6, into a DC voltage output at a level required for energization of the lifting magnet device. The DC-DC converter 7 has a DC voltage step-up and step-down function as well as a switching function by which DC power remains unchanged (variation of DC power being zero) before and after step-up or step-down of a DC voltage. The output terminal of the DC-DC converter 7 is connected with a coil 8*a* of the lifting magnet device 8.

The DC-DC converter 7 is controlled by a controller 9 to perform conversions. Each of the components subsequent to the converter 6 is operated by turning ON or OFF a control switch (not shown) connected to the controller 9. Furthermore, a DC line 10 from the DC-DC converter 7 is connected with a large-capacitance capacitor 11 for accommodating energy to be stored in the coil 8*a*.

On the other hand, the discharge outlet of the main pump 2 is in communication with the fluid supply port of a control valve 12 which has a direction switching function. The control valve 12 has a plurality of switching positions. Thus, an output port at one switching position is connected with a cylinder 13 used for a boom, an arm, a fork, or the like, while an output port at the other switching position is connected with a hydraulic motor 14 which is used for pivotal motion, rightward traveling, leftward traveling, or the like.

Then, the electric generator 5 is rotated by the engine 1 via the generator hydraulic pump 3 and the generator hydraulic motor 4 to generate alternate current. When the control switch connected to the controller 9 is turned ON, the converter 6 converts the AC output of the electric generator 5 into a DC output. Then, the DC output is in turn converted by the DC-DC converter 7 into a DC voltage at a required level to be supplied to (the coil 8*a* of) the lifting magnet device 8. Therefore, retainable attraction of objects is initiated.

As shown in FIG. 5, at the initiation of the retainable attraction, a voltage greater than a rated voltage is applied to the coil 8*a* of the lifting magnet device 8 for intense energization thereof. After a predetermined period of time has elapsed from the intense energization, steady-state energization is effected through application of a rated voltage. At the time of a release after the period of time of the steady-state energization, a termination of voltage application to the coil 8*a* causes the energy stored in the coil 8*a* to be accommodated by a condenser 11. After the termination of the application of the rated voltage to the coil 8*a*, a predetermined reverse voltage is applied thereto for demagnetization. After a predetermined period of time has elapsed from the initiation of the demagnetization, the application of the reverse voltage is terminated, thereby ending the lifting operation.

As a specific conventional technique related to the handling machine using a lifting magnet, a lifting magnet device is known which is disclosed, e.g., in the publication of Japanese Patent No. 3395145. This conventional technique includes a controller and a lifting magnet main body, and the controller is connected with an electrical power source for the handling machine. The electrical power source is an alternator serving as a standard electrical power source which is typically provided in a handling machine, and the alternator employed has a rated voltage of 24V DC and a rated capacity of 50 A. On the other hand, the rated voltage employed for the lifting magnet main body is the same as the rated voltage of the alternator. Thus, the controller is configured to supply a predetermined control voltage to the lifting magnet main body using the output from the electrical power source as input power. Such a configuration allows the conventional technique to dispense with a dedicated power source.

In the aforementioned conventional technique according to Japanese Patent No. 3395145, a so-called alternator at 24V DC for electrical components, which is normally provided in a handling machine, is used as an electrical power source to drive the lifting magnet main body. That is, this configuration can be said to regard the lifting magnet main body as one of the electrical components. However, the lifting magnet main body driven by 24V DC provides a weak retainably attracting force in practice, and in particular, cannot provide sufficient power for the intensely energized portion of FIG. 5.

Accordingly, retainably attracting force for practical use was obtained as follows. That is, as already discussed in the example of FIG. 4, the generator hydraulic pump installed on the drive shaft of the engine was typically used to drive the generator hydraulic motor, thereby driving the electric generator to obtain predetermined electric power.

However, this configuration caused problems such as low energy efficiency and tremendous increase in the size of the apparatus. In particular, by nature, the lifting magnet device needs to be ready all the time to be supplied with high electric power output so as to be intensely energized when starting a retainable attraction. To this end, it was necessary to prepare a corresponding large engine or for a slightly smaller engine to be rotated at high speeds all the time. Therefore, this readily causes problems such as increase in costs and size of the apparatus, decrease in energy efficiency, and increase in noise. Furthermore, with this configuration, it was also necessary to prepare a large-capacitance condenser for accommodating energy stored in the coil of the lifting magnet device. This also causes increase in the size of the energization-related components of the lifting magnet device.

DISCLOSURE OF THE INVENTION

The present invention has been devised to solve these conventional problems. It is therefore an object of the present invention to provide a handling machine using a lifting magnet, the handling machine being able to efficiently utilize energy by taking advantage of the property of a lifting magnet device to reduce the size of the power source or energization-related components (or to enhance them if they remain the same in size) as well as to realize reductions in costs, energy consumption, and noise.

To solve these problems, the present invention provides a handling machine using a lifting magnet. The handling machine has a lifting magnet device, a lower traveling body, and an upper rotary body. The handling machine is characterized by including: a power source; a storage battery for storing electric energy from the power source; and a drive source for a driven body in which regenerative electric energy can be produced in the handling machine, and is characterized in that the power source and the storage battery are connected to be capable of supplying electric energy to the lifting magnet device, that the drive source for the driven body in which the regenerative electric energy can be produced is connected to be capable of supplying its own regenerative electric energy to the storage battery, and that the drive source for the driven body is also connected to be capable of supplying the regenerative electric energy to the lifting magnet device without the intervention of the storage battery.

The handling machine according to the present invention includes the power source and the storage battery for storing electric energy from the power source. The power source and the storage battery are connected to be capable of supplying electric energy to the lifting magnet device. In principle, this configuration allows the lifting magnet device to receive electric energy from both the power source and the storage battery. On the other hand, for example, the handling machine of this type always has a driven body, which is powered by a drive source like a power source or a hydraulic pump, such as a traveling mechanism of the lower traveling body, a pivotal mechanism of the upper rotary body, or a handling mechanism, like a boom or an arm, for moving or positioning the lifting magnet device up and down or back and forth.

Here, by nature, the handling machine using a lifting magnet may often repeatedly allow the lifting magnet device to be lowered and energized for retainable attraction at a certain location, to be raised and rotationally moved to another location, to be released at the another location, and to be returned to and lowered at a location for re-energization. In most cases, those driven bodies are decelerated and stopped "at the same time" as the initiation of energization of the lifting magnet device. In other words, "when a driven body such as the pivotal mechanism, the boom, or the arm is decelerated and stopped," i.e., "when regenerative energy (regenerative electric power) can be recovered from that driven body," the lifting magnet device often requires a large amount of electric power for the initiation of its energization.

The present invention has been devised by focusing attention on this point. Thus, such a configuration has been employed which can not only store regenerative electric energy produced at a driven body in a storage battery but also directly supply the energy to the lifting magnet device (not via the storage battery). This configuration makes it possible to efficiently supply a large amount of electric power required for an intense energization at the initiation of a retainable attraction to the lifting magnet device. This can be done even without employing an engine and a storage battery of a not-so-large capacity, or without running an engine at high speeds all the time. It is thus possible to provide reductions in size of the apparatus and noise. Conversely, the same power source or the same storage battery as a conventional one can be prepared to provide more powerful retainable attraction than before.

Furthermore, no intervention of a storage battery accordingly allows for maintaining a high efficiency of energy recovery. In this regard, a reduction in energy consumption can also be expected.

Examples of variations of the present invention may include, in addition to the above configuration, a handling machine using a lifting magnet that has the lifting magnet device connected to be capable of supplying the regenerative electric energy, which is produced when the lifting magnet device is released, to the drive source for the driven body without the intervention of the storage battery.

The lifting magnet device produces regenerative electric energy when releasing magnetic materials at a location to which the materials have been transferred. At this time, in most cases, the boom starts to be raised and the pivotal mechanism starts a pivotal motion to move back to the original location. This configuration makes it possible to supply the regenerative electric energy obtained from the lifting magnet device to the drive source for these driven bodies without the intervention of the storage battery, thereby starting to drive these driven bodies smoothly and efficiently.

For example, as a modified example of the present invention, such a configuration may be conceivable in which the drive source for a driven body, in which regenerative electric energy can be produced in the handling machine, is a drive source for the pivotal mechanism of the upper rotary body.

With the handling machine using a lifting magnet, the motions that are thought to take place necessarily at the initiation of a retainable attraction include decelerating and stopping of the pivotal mechanism of the upper rotary body. This is because most of the operations of the handling machine using a lifting magnet are to move magnetic materials such as steel members present at a particular location to another. Accordingly, the effects unique to the present invention can be prominently obtained by allowing the regenerative electric energy from the drive source for the pivotal mechanism of the upper rotary body to be directly supplied to the lifting magnet device.

As another modified example of the present invention, for example, such a configuration may be conceivable in which the drive source for a driven body, in which regenerative electric energy can be produced in the handling machine, is a drive source for a boom for controlling a position of lifting by the lifting magnet device.

With the handling machine using a lifting magnet, the motions that are thought to take place necessarily at the initiation of a retainable attraction include decelerating and stopping of the lowering of the boom to control the position of lifting by the lifting magnet device. This is due to the nature of the operations that are carried out by the handling machine using a lifting magnet. That is, to retainably attract magnetic members such as steel materials present at a particular location, the boom needs to be driven to lower the lifting magnet device down to a level where the magnetic materials can be retainably attracted. The retainable attraction is often initiated at the same time as the boom is decelerated and stopped when being lowered. In this regard, as in this modified example, the regenerative energy from the boom drive source can be supplied to the lifting magnet device without the intervention of the storage battery, thereby providing prominent effects unique to the present invention.

Note that as used herein, the phrase "a boom for controlling the position of lifting by the lifting magnet device" may include a boom which is defined in a strict sense and typically used in contrast with an arm. In addition, also included is a boom defined in a broad sense, e.g., including such a strictly defined arm that is employed in a configuration in which the strictly defined boom is installed at a fixed angle and the arm is repeatedly displaced up and down to control the position of lifting by the lifting magnet device.

Note that in the present invention two or more drive sources for a driven body may be provided, which are connected to the lifting magnet device (without the intervention of the storage battery), as will be discussed in an embodiment below.

As another modified example of the present invention, such a configuration may be conceivable in which the power source has an engine mounted in the handling machine and an electric generator activated by the engine for power generation.

According to the present invention, the power source is not limited to a specific configuration. However, according to this modified example, no intervention of a hydraulic pump and a hydraulic motor allows for realizing accordingly efficient power generation. It is also possible to reliably supply an amount of electric energy required by the lifting magnet device, regardless of its capacity, depending on the selected capacities of the engine and the electric generator.

Note that when the power source is formed of an engine and an electric generator in this manner, for example, the electric generator may be set so as to generate average electric power that is required for the lifting magnet device to perform one cycle of energization from the initiation of retainable attraction of objects to the release thereof.

In the present invention, the regenerative energy produced in a driven body of the handling machine is efficiently utilized for supplying electric power to energize the lifting magnet device. Therefore, it is not necessary to generate electric power in preparation for intense energization as conventionally practiced. This configuration makes it possible to reduce the electric generator in size accordingly. In addition to this, there is no need to operate the engine all the time at high rotational speeds in an auxiliary manner so that the maximum output can be delivered all the time. It is thus possible to reduce the maximum rotational speed of the engine. Therefore, it is possible to obtain advantages of realizing reductions in power consumption and noise at the same time.

Conversely, for example, even when a standard 24V DC alternator, which is typically installed in the handling machine, is used as an electric generator, it is possible to provide a retainable attracting force greater than before. This can provide a wider range of applications.

As another modified example of the present invention, such a configuration is conceivable in which the storage battery has both a secondary battery and a capacitor.

According to this modified example, the synergistic effect provided by the secondary battery favorable in terms of ensuring capacity and the capacitor favorable in terms of response, makes it possible to perform large-capacity and response-enhanced storage of electricity. Thus, this can realize a large-capacity retainable attraction that is improved in operability.

In this case, such a controller may be included which enables a choice to be made as to which the recovered regenerative electric energy is stored in the secondary battery or the capacitor. This can realize the aforementioned operation with the maximum efficiency.

As still another modified example of the present invention, it is more preferred that the power source and the storage battery are connected to be capable of supplying electric energy to the lower traveling body.

According to this modified example, depending on the design, it is possible to provide a handling machine that is entirely powered by electricity.

The present invention can also be considered to be a method for operating a handling machine using a lifting magnet, the handling machine having a lifting magnet device, a lower traveling body, and an upper rotary body. For example, the method may include: a first electric energy supply step of storing electric energy from a power source in a storage battery; a second electric energy supply step of supplying electric energy from the power source and the storage battery to the lifting magnet device; and a third electric energy supply step of supplying regenerative electric energy from a drive source for a driven body, in which the regenerative electric energy can be produced, to the lifting magnet device without the intervention of the storage battery.

Furthermore, the present invention can be considered to be a method for operating a handling machine using a lifting magnet, the handling machine having a lifting magnet device, a lower traveling body, and an upper rotary body. The method includes: a first electric energy supply step of storing electric energy from a power source in a storage battery; a second electric energy supply step of supplying electric energy from the power source and the storage battery to the lifting magnet device; a third electric energy supply step of supplying regenerative electric energy from a drive source for a driven body, in which the regenerative electric energy can be produced, to the lifting magnet device without the intervention of the storage battery; and a fourth electric energy supply step of supplying regenerative electric energy, produced when the lifting magnet device is released, from the lifting magnet device without the intervention of the storage battery, to the drive source for the driven body, in which the regenerative electric energy can be produced.

The present invention makes it possible to efficiently utilize regenerative energy by making use of the property of a lifting magnet device. This advantage can be applied to realize enhancement of the power source and energization-related components and reductions in size, costs, energy consumption, and noise of the power source and energization-related components, corresponding to the properties required of the handling machine, depending on its design.

BEST MODE FOR CARRYING OUT THE INVENTION

Figure 1:
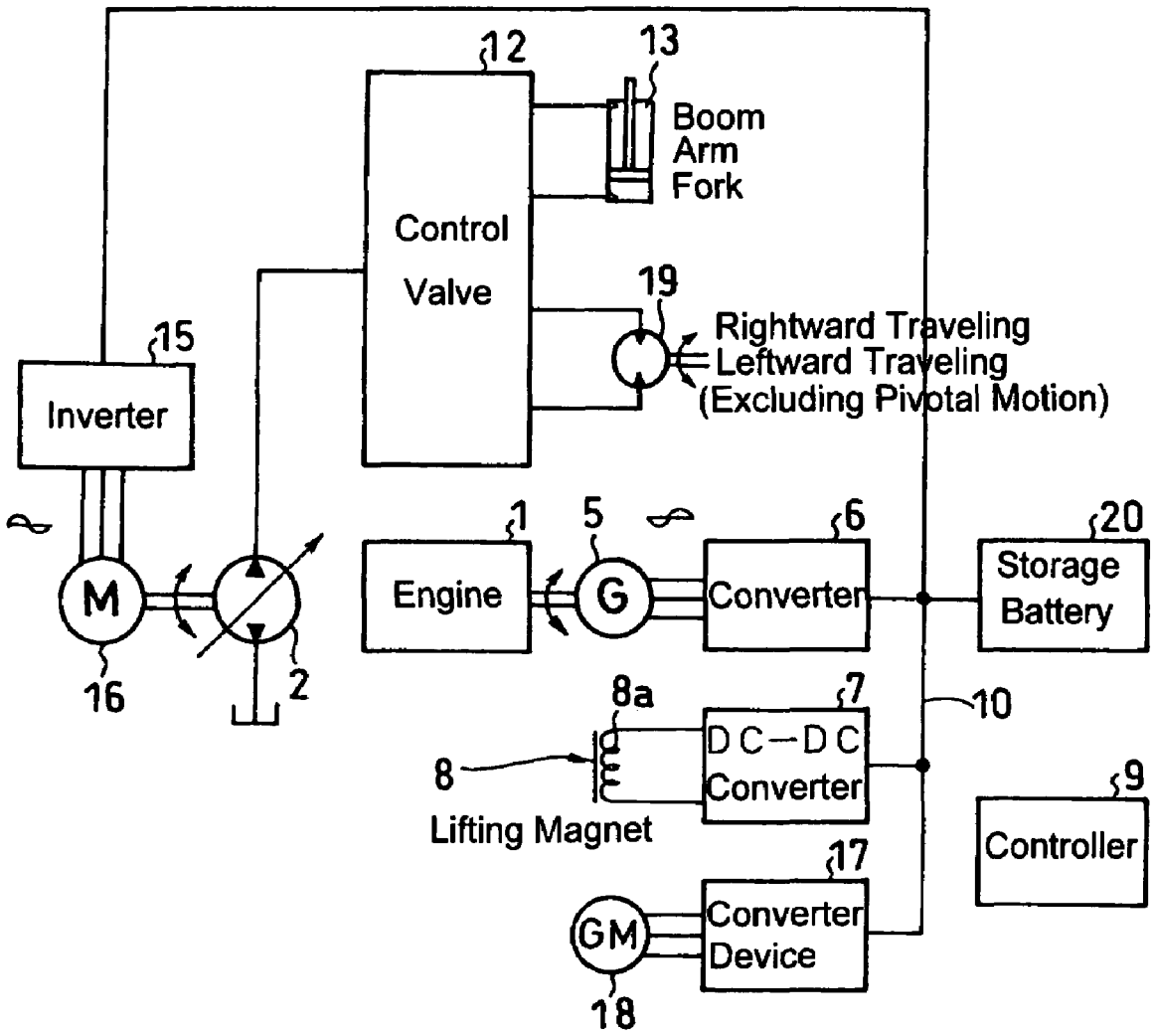
FIG. 1 is a block diagram showing the configuration of a handling machine using a lifting magnet according to a first embodiment.

A description will be given below in more detail with reference to the drawings in accordance with exemplary embodiments of a handling machine using a lifting magnet to which the present invention is applied. FIG. 1 is a block diagram showing the configuration of a handling machine using a lifting magnet. Note that throughout FIG. 1, and FIGS. 2 and 3 that follow showing the embodiments discussed below, same reference symbols are used to identify the components similar or equivalent to those of FIG. 4, and they will not be repeatedly explained.

To begin with, with reference to FIG. 1, a description will be given of the configuration of the handling machine using a lifting magnet according to a first embodiment. Note that FIG. 1 shows only schematically the connections between respective components and thus not precisely reflects the actual wiring.

In the first embodiment, the drive shaft of the engine 1 is provided with only the electric generator 5. The engine 1 and the electric generator 5 (more specifically, the engine 1, the electric generator 5, and the converter 6 for AC to DC conversion) form a power source. The electric generator 5 is connected with a DC line 10 via the converter 6. Note that provided in a stage upstream of the main pump (hydraulic pump) 2 for a hydraulic actuator are an inverter 15 for converting a DC voltage appearing on the DC line 10 into an AC voltage for output, and an electric motor 16 that is rotationally driven by the AC output from the inverter 15. In this configuration, the main pump 2 is installed on the output shaft of the electric motor 16.

The DC line 10 is connected with a storage battery 20, and the coil 8*a* of the lifting magnet device 8 via the DC-DC converter 7. The DC line 10 is also provided with a converter device 17 which has both an inverter function for DC-to-AC conversion and a converter function for AC-to-DC conversion. The converter device 17 is connected with a generator motor 18 having a function serving as a drive source for the pivotal mechanism of the upper rotary body in the handling machine. As such, in the first embodiment, since the upper rotary body is driven by the generator motor 18, the output port at the other switching position of the control valve 12 is connected with a hydraulic motor 19 used only for rightward traveling or leftward traveling except for pivotal motion.

The electric generator 5 generates AC power corresponding to average electric power. The average electric power is required for one cycle of energization of the lifting magnet device 8 from the initiation of intense energization for retainable attraction of objects to the release thereof. The electric generator 5, however, does not generate power intended to feed electric power for the intense energization.

As the storage battery 20, a secondary battery such as a lithium-ion battery or an electric double layer capacitor having a high input/output density is available. The electric double layer capacitor provides a good response when accommodating electric energy, while the secondary battery is capable of storing a large amount of electric energy. In the first embodiment, the storage battery 20 includes both the secondary battery and the capacitor (both not shown), and the controller 9 can select which the regenerative electric energy recovered is stored, in the secondary battery or the capacitor. Note that the secondary battery may include a nickel metal hydride battery or a lead-acid battery other than the lithium-ion battery. Alternatively, such a storage battery that is combined with a power generation device like fuel cells may also be employed.

The storage battery 20 stores the DC electric energy that is obtained through an AC-to-DC conversion of the AC output from the electric generator 5 by the converter 6. The storage battery 20 is also capable of transmitting and receiving electric energy to and from the lifting magnet device 8 via the DC-DC converter 7. That is, at the time of releasing objects by the lifting magnet device 8, the storage battery 20 can accommodate the energy stored in the coil 8*a* and accumulate it as DC electric energy. On the other hand, at the time of energization of the lifting magnet device 8, the storage battery 20 can also supply the DC electric energy stored therein to the lifting magnet device 8.

Furthermore, the storage battery 20 also has functions to transmit and receive electric energy to and from the generator motor 18 via the converter device 17. That is, the storage battery 20 can store the regenerative electric energy, which is produced at the time of braking of the generator motor 18, via the converter device 17. On the other hand, during operation of the generator motor 18, the storage battery 20 can supply electric energy to the generator motor 18 via the converter device 17 so as to operate the generator motor 18 as an electric motor.

Here, the first embodiment is configured such that electric energy can be transmitted and received between the lifting magnet device 8 and the generator motor 18 serving as the pivotal motion drive source for the upper rotary body (without the intervention of the storage battery 20). That is, at the time of energization of the lifting magnet device 8, the regenerative electric energy recovered at the generator motor 18 can be supplied to the lifting magnet device 8 without the intervention of the storage battery 20. In other words, for example, only at the time of an intense energization or when the electric energy generated by the electric generator 5 and the regenerative electric energy provided by the generator motor 18 are not sufficient enough to meet the power requirements of the lifting magnet device 8, the storage battery 20 supplies electric power to the lifting magnet device 8.

On the other hand, at the time of a release of the lifting magnet device 8, the regenerative electric energy recovered at the lifting magnet device 8 can be supplied to the generator motor 18 without the intervention of the storage battery 20. In other words, only when the electric energy generated by the electric generator 5 and the regenerative electric energy provided by the generator motor 18 are not sufficient enough to drive the generator motor 18, the storage battery 20 supplies electric power to the generator motor 18.

In either case, when the amount of electric energy generated or regenerated exceeds the amount of electric energy then required by any part of the handling machine, the excess amount is to be stored in a storage battery 20.

Note that each of the corresponding components such as the engine 1, the output of the main pump 2 (or its discharge flow rate), the electric generator 5, the converter 6, the inverter 15, the converter device 17, and the electric motor 16 is controlled by a control circuit provided in the controller 9, through a relay, a switch or the like (not shown).

A description will now be given of the operation of the handling machine using a lifting magnet configured as described above. The electric generator 5 is rotationally driven directly by the engine 1 to generate AC power. The AC power generated by the electric generator 5 is converted into DC power by the converter 6, and thereafter, the resulting DC power is supplied via the DC-DC converter 7 as electric power to energize the coil 8*a* of the lifting magnet device 8. The DC power is also supplied to the generator motor 18 via the converter device 17 to drive the upper rotary body. Furthermore, the DC power is also supplied to the electric motor 16 via the inverter 15 to drive a required hydraulic actuator. As such, the electric power generated by the electric generator 5 is principally used to drive the coil 8*a* of the lifting magnet device 8, the generator motor 18 of the upper rotary body, and the electric motor 16 for a required hydraulic actuator.

Here, a further detailed description will give of how the coil 8*a* of the lifting magnet device 8 is energized. As described above, the electric generator 5 generates the AC power corresponding to the average electric power that is required for one cycle of energization of the lifting magnet device 8 from the initiation of an intense energization for retainable attraction of objects to the release thereof. When the control switch connected to the controller 9 is turned ON, the AC output from the electric generator 5 is converted into DC output by the converter 6. Then, the resulting DC output is converted by the DC-DC converter 7 into a DC voltage at a required level to be supplied to the coil 8*a* of the lifting magnet device 8.

The application of the DC voltage to the coil 8*a* causes the lifting magnet device 8 to be energized, thereby initiating a retainable attraction of objects. To start the retainable attraction, high electric power is necessary which is required for an intense energization. Accordingly, when regenerative electric energy is available on the generator motor 18 side for driving the rotary body in addition to the electric energy generated by the electric generator 5, the regenerative electric energy is supplied directly to the lifting magnet device 8 (not by way of the storage battery 20).

A handling machine using a lifting magnet often repeats such an operation as moving magnetic members such as ferrous materials from one particular location to another. In this instance, the pivotal mechanism of the upper rotary body is often decelerated or stopped at the same time as a retainable attraction or before or immediately after it. In this regard, the regenerative electric energy recovered from the generator motor 18 is directly fed into the lifting magnet device 8 without the intervention of the storage battery 20. This allows part of the electric power required for an intense energization to be efficiently supplied thereto.

Note that when there is still a shortage of power, the storage battery 20 having DC electric energy stored therein also supplies the electric energy to the lifting magnet device 8 so as to relieve the shortage.

After an intense energization of the lifting magnet device 8, a rated voltage is applied thereto for steady-state energization. At the time of a release when the application of the rated voltage is terminated after the period of time of the steady-state energization, the energy stored in the coil 8*a* of the lifting magnet device 8 is regenerated. Note that when the generator motor 18 is about to be driven at the time of the regeneration in order to drive the upper rotary body, the regenerative electric energy is used to drive the generator motor 18 in conjunction with the electric energy generated by the electric generator 5. As a result, an excess amount of energy would be stored in the storage battery 20, whereas a shortage would be supplemented with a supply from the storage battery 20.

After the termination of the rated voltage application to the coil 8*a*, a predetermined reverse voltage is applied thereto for demagnetization. The application of the predetermined reverse voltage is performed using a polarity switching circuit (not shown) by switching the polarity of the DC output voltage of the DC-DC converter 7. After a predetermined period of time has elapsed from the initiation of the demagnetization, the application of the reverse voltage is terminated, thereby ending the lifting operation.

Furthermore, when the electric power generated by the electric generator 5 is used to rotationally drive the electric motor 16 that is to drive a required hydraulic actuator, the AC output of the electric generator 5 is converted into a DC output by the converter 6, and the resulting DC output is supplied to the electric motor 16 via the inverter 15. Then, to drive the required hydraulic actuator, the storage battery 20 appropriately supplies electric power to the electric motor 16.

As described above, the handling machine using a lifting magnet according to the first embodiment is configured such that the electric generator 5 can be directly rotationally driven by the engine 1. This can increase the efficiency of power generation for the lifting magnet device 8 to be efficiently energized and can efficiently drive the generator motor 18 used for the upper rotary body. It is also possible to efficiently supply the regenerative electric energy produced at each of the lifting magnet device 8 and the generator motor 18 to each other, thereby realizing highly energy-efficient operations as a whole.

That is, in particular, it is possible to supply a sufficient amount of electric energy for an intense energization of the lifting magnet device 8. Nevertheless, neither the electric generator 5 nor the storage battery 20 necessarily needs to have a capacity enough to feed the electric energy required for an intense energization of the lifting magnet device 8.

As a result, this allows for employing an engine or a storage battery which has a corresponding reduced capacity, or operating a conventional engine at reduced speeds when compared with conventional ones. It is thus possible for the lifting magnet device 8 and those devices used in the drive system for the upper rotary body to be reduced in size, costs, energy consumption, and noise.

Figure 2:
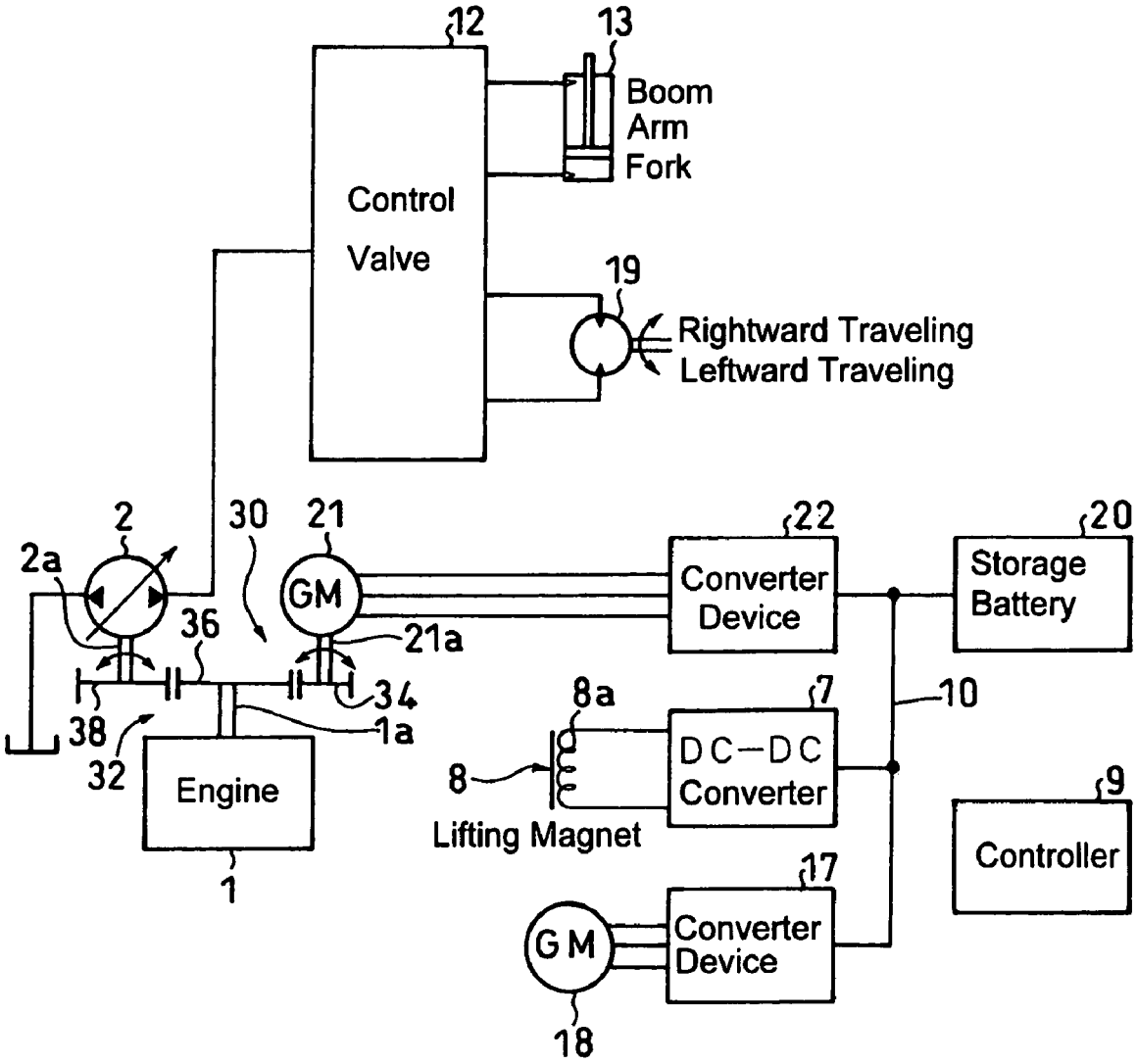
FIG. 2 is a block diagram showing the configuration of a handling machine using a lifting magnet according to a second embodiment.

A detailed description will now be given of a second embodiment of the present invention with reference to the drawings. FIG. 2 is a block diagram showing the configuration of a handling machine using a lifting magnet.

The engine 1 has a drive shaft 1*a* on which a generator motor 21 and the main pump 2 are installed in parallel via first and second gearboxes 30 and 32. The generator motor 21 forms a power source in conjunction with the engine 1 and serves not only as an electric generator but also as an electric motor. The main pump 2 is used for a hydraulic actuator.

The first gearbox 30 is configured to include a pinion 34 installed on a drive shaft 21*a* of the generator motor 21 and a gear 36 installed on the drive shaft 1*a* of the engine 1. The first gearbox 30 functions as a speed reducer when viewed from the generator motor 21 towards the engine 1, and functions as a speed accelerator when viewed from the engine 1 towards the generator motor 21. Furthermore, the second gearbox 32 is configured to include the gear 36 and a pinion 38 installed on a drive shaft 2*a* of the main pump 2, and functions as a speed accelerator when viewed from the engine 1 towards the pump 2.

The other components are configured generally in the same manner as those of the first embodiment.

Now, the generator motor 21 and the main pump 2 are rotationally driven in common by the engine 1 via the gearboxes 30 and 32 so that the generator motor 21 generates AC power. The AC power generated by the generator motor 21 is converted into DC power by a converter device 22, and the resulting DC power reaches the DC line 10. The storage battery 20, the DC-DC converter 7, the lifting magnet device 8, the converter device 17, and the generator motor 18 are configured and operated basically in the same manner as those of the aforementioned first embodiment.

On the other hand, when a high load is required of the main pump 2 at the time of the main pump 2 driving a required hydraulic actuator, electric power is supplied from the storage battery 20 to the generator motor 21 via the converter device 22, thereby driving the generator motor 21 as an electric motor. In this manner, torque assistance to the engine 1 is provided so as to obtain a pump output corresponding to the high load from the main pump 2.

As described in the foregoing, the construction machine using a lifting magnet according to the second embodiment provides generally the same operational effects as those of the first embodiment. Furthermore, when a high load is required of the main pump 2, electric power can be supplied from the storage battery 20 to the generator motor 21 to drive the generator motor 21 as an electric motor and thus provide torque assistance to the engine 1. For this reason, even the engine 1 smaller in size still allows the main pump 2 to provide a pump output corresponding to the high load. In addition, to drive not only the lifting magnet device 8 and the generator motor 18 but also the main pump 2, the engine 1 needs not to be operated at high rotational speeds in an auxiliary manner in order to supply the maximum output all the time. It is thus possible to further reduce the maximum rotational speed of the engine 1, thereby allowing further reductions in power consumption and noise as well.

Note that in the configurations of FIGS. 1 and 2, a step-up and step-down converter for voltage adjustments may also be interposed between the DC line 10 and the storage battery 20. An electric actuator (not shown) having a regenerating function can also be connected to the DC line 10 to obtain the same effects as those of the generator motor 18.

Figure 3:
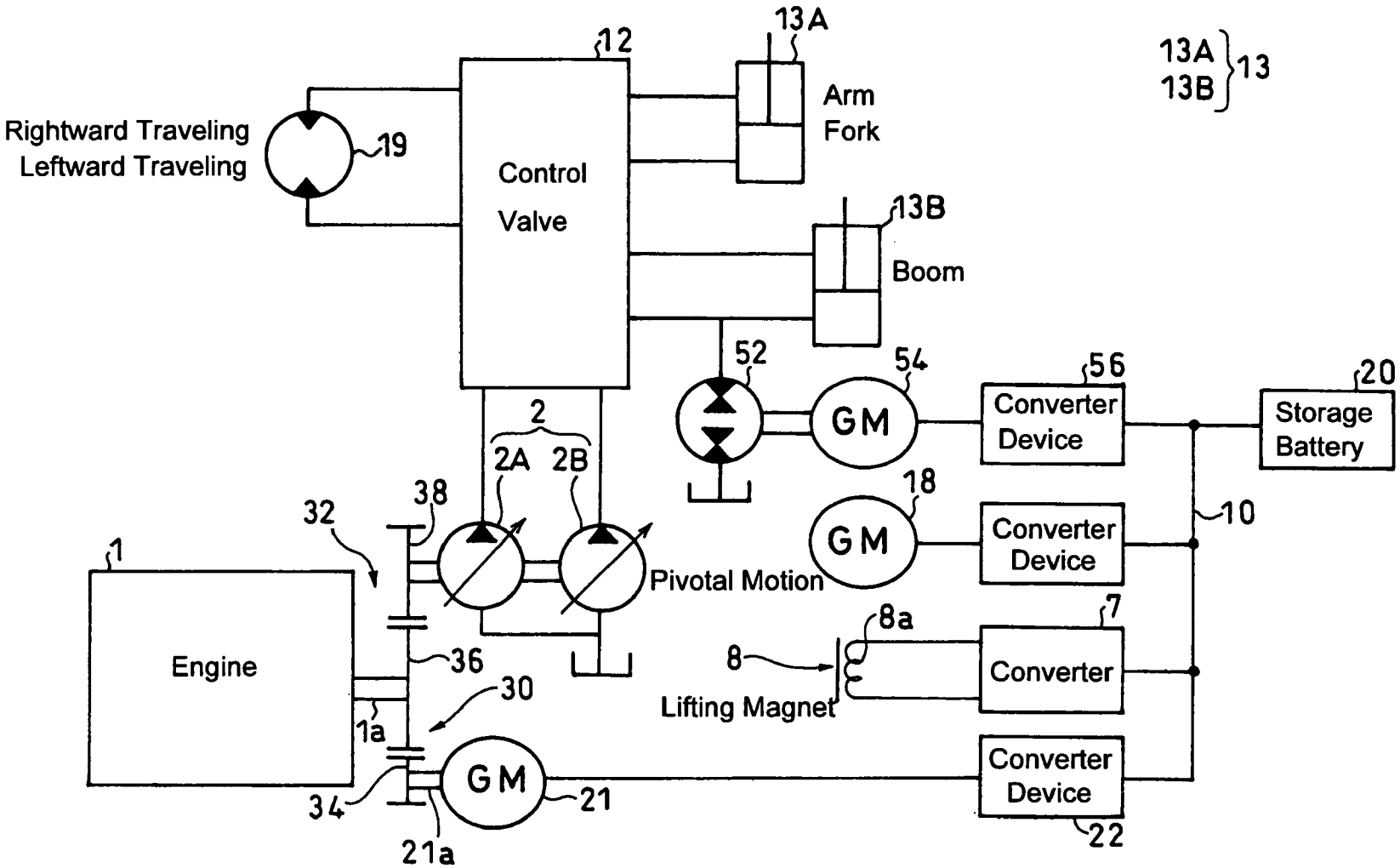
FIG. 3 is a block diagram showing the configuration of a handling machine using a lifting magnet according to a third embodiment.
Figure 4:
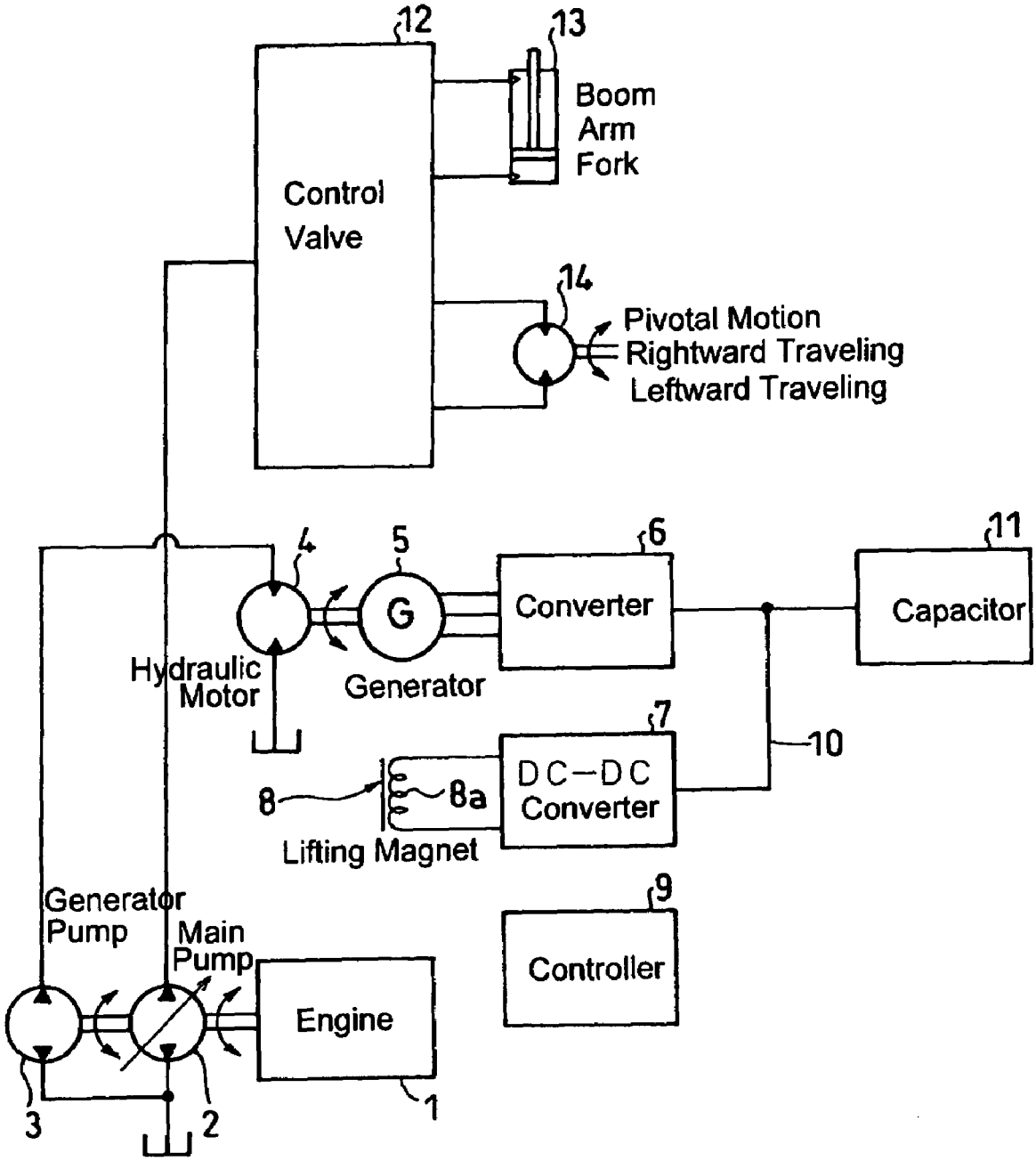
FIG. 4 is a block diagram showing the configuration of a conventional handling machine using a lifting magnet.
Figure 5:
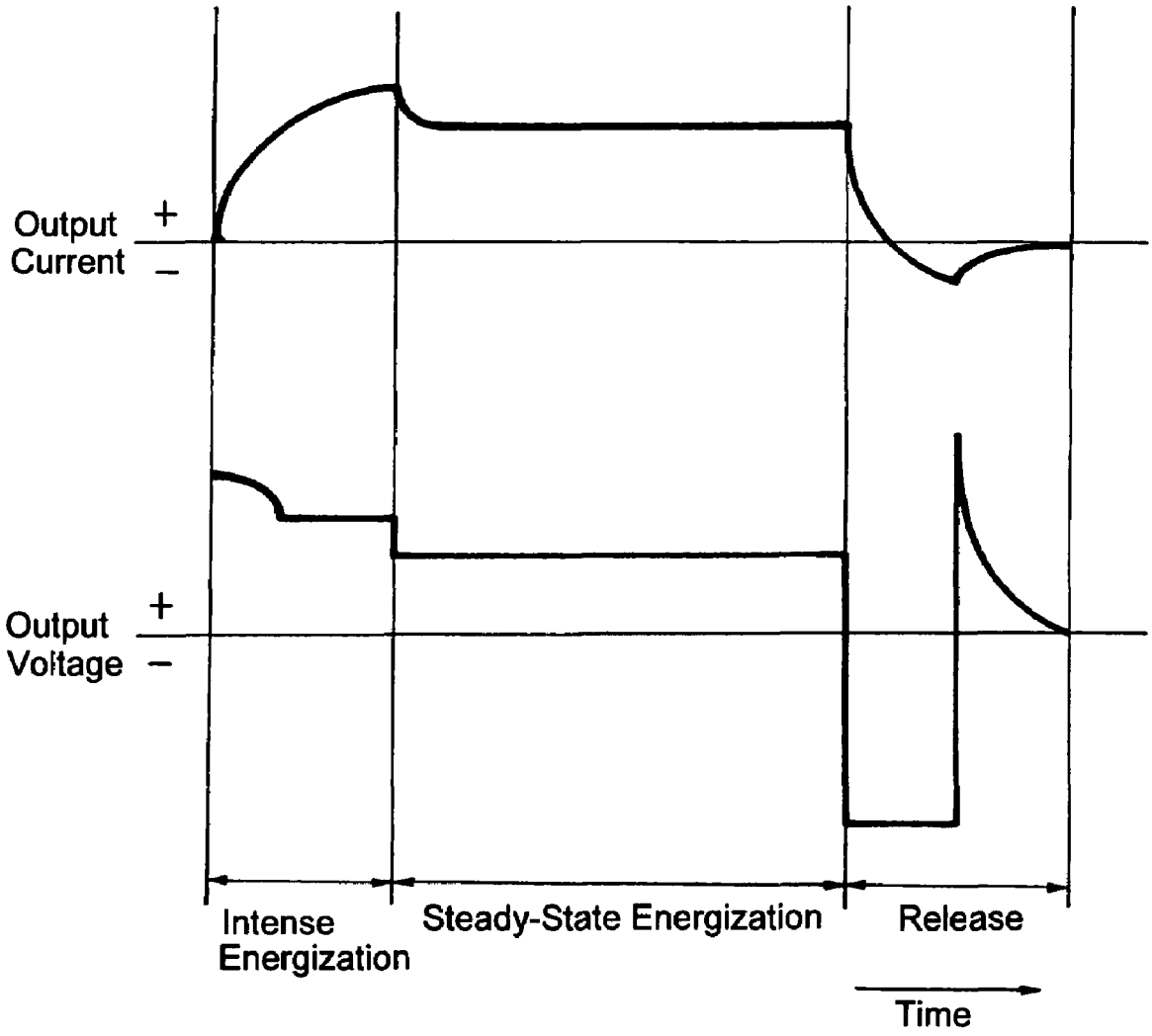
FIG. 5 is a waveform diagram of an applied voltage and current in the handling machine using a lifting magnet of FIG. 4.

FIG. 3 shows a third embodiment of the present invention. The third embodiment is based on the configuration of the second embodiment described above and is configured such that a boom cylinder 13B for driving a boom is connected at the bottom side thereof with a both-way pump motor 52, and a generator motor 54 is also coupled thereto. The generator motor 54 is connected to the DC line 10 via a converter device 56.

According to this configuration, when the boom cylinder 13B is contracted (i.e., the boom is lowered), the energy of the pressurized oil present on the bottom side can be regenerated via the both-way pump motor 52 and the generator motor 54. Like the regenerative electric energy recovered at the generator motor 18 used for the pivotal mechanism as in the first and second embodiments discussed above, the regenerated energy can also be utilized as electric energy for driving the lifting magnet device 8.

A substantial amount of regenerative electric energy can be recovered when the boom cylinder 13B is contracted, and therefore a tremendous effect can be provided using the regenerated energy as is (i.e., without the intervention of the storage battery 20) for the energization of the lifting magnet device 8. As a result, in particular, a large amount of electric power required for an intense energization of the lifting magnet device 8 can be supplied in a further efficiency-improved manner.

On the other hand, in this configuration, the boom is not fully driven by electric power, but the boom itself is basically driven by a hydraulic drive system. For this reason, it is not necessary to prepare either a large electric motor for driving the boom or a large-capacity power source system for driving that large electric motor. Thus, in principle, the conventional configuration has to be only slightly modified to realize efficient utilization of energy.

Furthermore, when the boom cylinder 13B is extended (i.e., the boom is raised), the pressurized oil can be supplied along the passage from the converter device 56 through the generator motor 54 to the both-way pump motor 52, as required, other than the path of hydraulic pumps 2A and 2B. It is thus made possible to raise the boom further smoothly.

Note that the regenerative electric energy from the boom cylinder 13B can also be accommodated and accumulated in the storage battery 20, as appropriate, (when an excess amount of energy is produced in the whole handling machine).

It is to be understood that a variety of modifications can be made to the present invention without departing from the spirit of the present invention, and those modifications also fall within the scope of the present invention. For example, a hydraulically driven portion is left in any of the aforementioned first to third embodiments; however, the present invention is also applicable to a handling machine in which the drive source for the lower traveling body is driven by electric energy from the storage battery or to a handling machine in which all the portions are driven not hydraulically but only electrically.

INDUSTRIAL APPLICABILITY

For example, the present invention is applicable to a handling machine using a lifting magnet that is often employed for construction machines.

The invention claimed is:

1. A handling machine using a lifting magnet, the handling machine having a lifting magnet device, a lower traveling body, and an upper rotary body, the handling machine being characterized by comprising:

a power source;

a storage battery for storing electric energy from the power source; and a drive source for a driven body in which regenerative electric energy can be produced in the handling machine, wherein the power source and the storage battery are connected to be capable of supplying electric energy to the lifting magnet device, the drive source for the driven body in which the regenerative electric energy can be produced is connected to be capable of supplying its own regenerative electric energy to the storage battery, and the drive source for the driven body is also connected to be capable of supplying the regenerative electric energy to the lifting magnet device without the intervention of the storage battery.

2. A handling machine using a lifting magnet, the handling machine having a lifting magnet device, a lower traveling body, and an upper rotary body, the handling machine being characterized by comprising:

a power source;

a storage battery for storing electric energy from the power source; and a drive source for a driven body in which regenerative electric energy can be produced in the handling machine, wherein the power source and the storage battery are connected to be capable of supplying electric energy to the lifting magnet device, the drive source for the driven body in which the regenerative electric energy can be produced is connected to be capable of supplying its own regenerative electric energy to the storage battery, the drive source for the driven body is also connected to be capable of supplying the regenerative electric energy to the lifting magnet device without the intervention of the storage battery, and the lifting magnet device is connected to be capable of supplying the regenerative electric energy, which is produced when the lifting magnet device is released, to the drive source for the driven body without the intervention of the storage battery.

3. The handling machine using a lifting magnet according to claim 1, wherein the drive source for the driven body, in which regenerative electric energy can be produced in the handling machine, is a drive source for a pivotal mechanism of the upper rotary body.

4. The handling machine using a lifting magnet according to claim 1, wherein the drive source for a driven body, in which regenerative electric energy can be produced in the handling machine, is a drive source for a boom for controlling a position of lifting by the lifting magnet device.

5. The handling machine using a lifting magnet according to claim 1, wherein the power source has an engine mounted in the handling machine and an electric generator activated by the engine for power generation.

6. The handling machine using a lifting magnet according to claim 5, wherein the electric generator is set so as to generate average electric power that is required for the lifting magnet device to perform one cycle of energization from the initiation of retainable attraction of an object to the release thereof.

7. The handling machine using a lifting magnet according to claim 1, wherein the storage battery has both a secondary battery and a capacitor.

8. The handling machine using a lifting magnet according to claim 7, further comprising a controller which enables a choice to be made as to which the recovered regenerative electric energy is stored in the capacitor or the secondary battery.

9. The handling machine using a lifting magnet according to claim 1, wherein the power source and the storage battery are connected to be capable of supplying electric energy to a drive source for the lower traveling body.

10. A method for operating a handling machine using a lifting magnet, the handling machine having a lifting magnet device, a lower traveling body, and an upper rotary body, the method comprising:

a first electric energy supply step of storing electric energy from a power source in a storage battery;

a second electric energy supply step of supplying electric energy from the power source and the storage battery to the lifting magnet device; and a third electric energy supply step of supplying regenerative electric energy from a drive source for a driven body, in which the regenerative electric energy can be produced, to the lifting magnet device without the intervention of the storage battery.

11. A method for operating a handling machine using a lifting magnet, the handling machine having a lifting magnet device, a lower traveling body, and an upper rotary body, the method comprising:

a first electric energy supply step of storing electric energy from a power source in a storage battery;

a second electric energy supply step of supplying electric energy from the power source and the storage battery to the lifting magnet device;

a third electric energy supply step of supplying regenerative electric energy from a drive source for a driven body, in which the regenerative electric energy can be produced, to the lifting magnet device without the intervention of the storage battery; and a fourth electric energy supply step of supplying regenerative electric energy, produced when the lifting magnet device is released, from the lifting magnet device without the intervention of the storage battery, to the drive source for the driven body, in which the regenerative electric energy can be produced.

* * * * *